United States Patent [19]

Zeilon

[11] 4,452,300

[45] Jun. 5, 1984

[54] METHOD FOR THE EXCHANGE OF HEAT BETWEEN LIQUID AND AIR AND AN APPARATUS FOR CARRYING THE METHOD INTO EFFECT

[76] Inventor: Sten O. Zeilon, Heimdahlsgatan 21, S-261 62 Glumslöv, Sweden

[21] Appl. No.: 403,638

[22] PCT Filed: Nov. 24, 1981

[86] PCT No.: PCT/SE81/00340

§ 371 Date: Jul. 23, 1982

§ 102(e) Date: Jul. 23, 1982

[87] PCT Pub. No.: WO82/01938

PCT Pub. Date: Jun. 10, 1982

[30] Foreign Application Priority Data

Nov. 25, 1980 [SE] Sweden ..... 8008235

[51] Int. Cl.[3] ..... F28F 25/02; F28D 9/00

[52] U.S. Cl. ..... 165/1; 165/46; 165/115; 165/166; 165/DIG. 8

[58] Field of Search ..... 165/46, DIG. 8, 115, 165/165, 166

[56] References Cited

U.S. PATENT DOCUMENTS

| | | | |
|---|---|---|---|
| 1,694,370 | 12/1928 | Burdick | 165/118 |
| 3,913,667 | 10/1975 | Meylan et al. | 165/115 |
| 4,119,140 | 10/1978 | Cates | 165/115 X |
| 4,133,377 | 1/1979 | de Lallee et al. | 165/118 |
| 4,216,820 | 8/1980 | Andrew | 165/166 |
| 4,372,897 | 2/1983 | Sanderson et al. | 165/166 X |

FOREIGN PATENT DOCUMENTS

| | | | |
|---|---|---|---|
| 2289870 | 5/1976 | France | 165/DIG. 8 |
| 56-25697 | 3/1981 | Japan | 165/46 |
| 56-146985 | 11/1981 | Japan | 165/46 |
| WO82/01938 | 6/1982 | PCT Int'l Appl. | 165/46 |

*Primary Examiner*—Sheldon J. Richter

*Attorney, Agent, or Firm*—Fleit, Jacobson, Cohn & Price

[57] ABSTRACT

Heat exchange between liquid (1) and air (2) is effected by causing the liquid (1) to flow, in the form of a liquid film (5) spreading under capillary action, between pairs (3) of vertically oriented band-shaped thin membranes (4*a* and 4*b*) held together by adhesive forces in the liquid film (5). The air flow (2) preferably is conducted in counterflow with the liquid flow (1) in gaps (6) surrounding the pairs of membranes (3). Exchange of heat between liquid and air occurs through the membrane walls (4*a*, 4*b*). The membranes (4*a* and 4*b*) preferably consist of a thin plastic film, for example matted polyester film.

10 Claims, 5 Drawing Figures

FIG.1
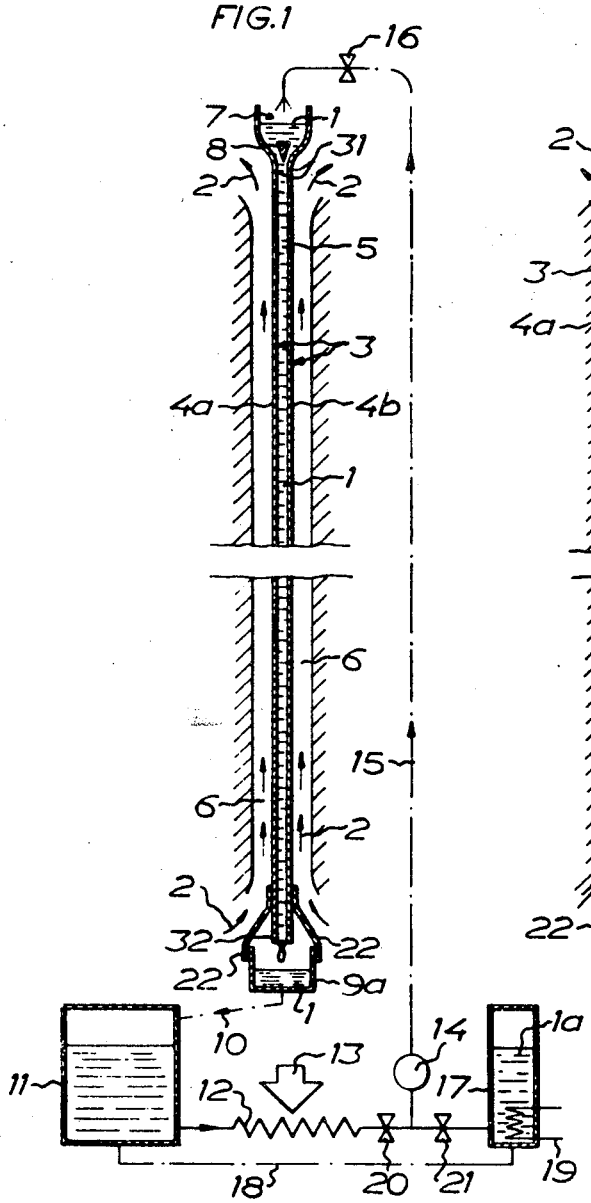
FIG.2
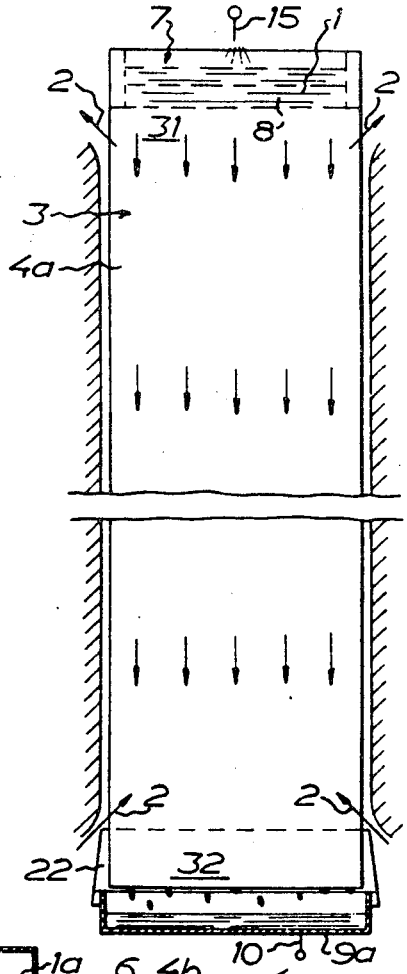
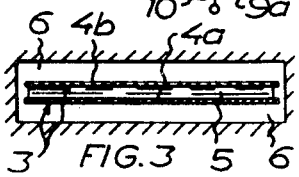
FIG.3

METHOD FOR THE EXCHANGE OF HEAT BETWEEN LIQUID AND AIR AND AN APPARATUS FOR CARRYING THE METHOD INTO EFFECT

The present invention relates to a method for the exchange of heat between liquid and air.

The exchange of heat between air and liquid, especially water, plays an important part in our use of energy, for instance in the cooling and heating of buildings, air treatment, industrial heating processes, such as drying etc. In many energy systems using, for example, heat pumps, solar heat, waste heat or district heating, the efficiency could be improved considerably if the flow resistance in the heat exchangers employed were reduced. However, this would result in heat transmission surfaces substantially larger than is economically feasible with today's technology.

Known heat exchangers for liquid/air are designed as closed pipe systems for liquid circulation, and the outer pipe surface area which is the heat-exchanging surface towards the air, is frequently increased by finning. To ensure stability and heat conductivity, the pipes and fins are preferably made of metal. Such heat exchangers are expensive and, besides, suffer from the disadvantage that the fins cause a certain flow resistance, and that it is difficult to defrost the space between the fins. Furthermore external and internal corrosion may occur.

The present invention has for its object to offer a method of effecting heat exchange between an air flow and a liquid flow by simple and inexpensive means having a high stability to external and internal corrosion and a very low resistance to heat conductivity. To realize this object, the liquid is caused to flow by gravity as a liquid film spreading under capillary action between two substantially vertically oriented membranes held together by the adhesive force in the liquid film, and air is conducted in contact with the sides of the membranes facing away from the liquid film for heat exchange through said membranes.

The invention also comprises a heat exchanger intended for carrying the above method into effect and characterised by a heat-exchanging surface consisting of at least two vertical band-shaped membranes, the surfaces of which are disposed opposite and at a slight distance away from one another and which are held together by a liquid film spreading under capillary action, means for supplying and uniformly distributing the liquid flow in the upper part of the space between said membranes, means for taking up the liquid from the lower part of said space between said membranes, and means for conducting the air into contact with the surfaces of said membranes facing away from one another.

The invention will be described in more detail in the following, reference being had to the accompanying drawings which illustrate embodiments of the invention.

FIG. 1 illustrates schematically in lateral vertical section a flow diagram during heat exchange according to the invention.

FIGS. 2 and 3 illustrate the heat exchanging surface of the arrangement as shown in FIG. 1 in a vertical section from in front and in a horizontal section, respectively.

Figure 4:
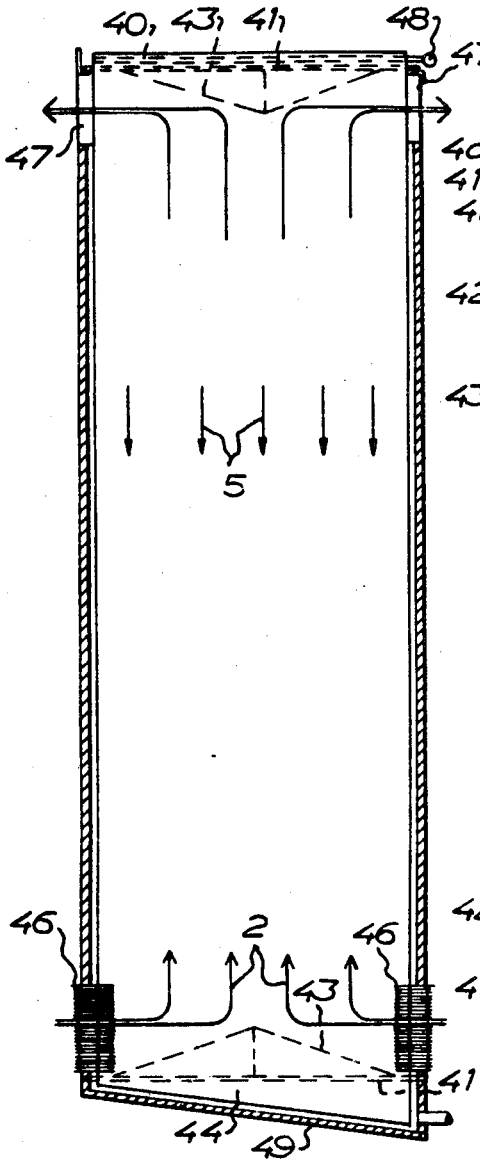
FIGS. 4 and 5 are, respectively, front and lateral sections, on a larger scale, of a practical embodiment of a heat exchanger according to the invention.

The method of effecting heat exchange according to the invention will be described first, with reference to FIGS. 1–3.

The invention utilizes as the heat-exchanging surface one or more band-shaped pairs of membranes 3 consisting of two thin membranes 4*a* and 4*b* held together by a film 5 of a liquid 1 spreading under capillary action. By suspending or clamping said pair of membranes 3 in vertial position and by supplying, without positive pressure, a weak flow of the liquid 1 along the upper horizontal opening 31 of said pair of membranes, a uniformly distributed downward flow of said liquid film 5 under the action of gravity and flow resistance is obtained. With small flows, the adhesive forces between the membrane surfaces are substantially greater than the static liquid pressures, and uniform flow pattern is obtained along the entire vertical extent of said pair of membranes 3.

Heat exchange from the liquid flow 1 spread in this manner occurs through the membrane walls to an air or gas flow 2 propelled in narrow gaps 6 surrounding said pair of membranes 3.

The air flow 2 preferably is propelled in counter-flow to the liquid flow 1.

The membranes 4*a* and 4*b* may be made of different materials and may be of the same or different thickness. The membrane surface facing the liquid film 5 should have a low surface tension to facilitate spreading of the film, while the membrane surface facing the air gap 6 preferably is hydrophobic to facilitate the release of dirt, condensate and ice from the surface.

To reduce costs and facilitate maintenance, the material used for the membranes preferably is a plastic film, for instance, a polyester film having a thickness of 50 μm, which is chemically or mechanically etched on one surface to increase wettability. With the above-mentioned membrane thickness, the resistance to heat conductivity in the membrane wall will be negligible, although the plastic material in itself is a poor heat conductor.

For continuous operation, the heat-exchanging surface 3 described above is incorporated in a flow circuit as shown in FIG. 1. A flow of a liquid 1 is supplied to the upper opening 31 of the pair of membranes 3 via an open supply vessel 7 and a flow-distributing throttle 8 and then flows over the membrane surface in heat-exchanging relation with the air flow 2. The liquid is discharged through the lower opening 32 of said pair of membranes 3 and is collected in a collecting vessel 9*a* and conducted, through an inclined conduit 10, to a supply tank 11 from where the liquid flows through a liquid heat exchanger 12 connected to an outer cooling or heating source 13 and continue to a circulation pump 14 which finally, via a riser pipe 15 and a flow-controlling valve 16, opens into the supply vessel 7.

By circulation of the liquid 1, heat exchange is effected between the cooling/heating source 13 and the air flow 2 in the gaps 6.

When, during operation, the air in the gaps 6 is cooled to a temperature below the freezing point, and frost or coatings of ice are formed on the upper part of said pair of membranes 3, such coatings are readily released and caused to fall out by periodically supplying, in accordance with the invention, liquid of higher temperature between said pair of membranes 3. To this end, there is connected to the flow circuit a vessel 17 which communicates with the supply tank 11 via a conduit 18 and which is partly filled with liquid 1*a* which is heated by means of a heating coil 19. The suction side of the pump 14 is connected by means of a solenoid valve 20 to the tank 11 and, by means of a solenoid valve 21, to the vessel 17. By periodically closing the valve 20 and opening the valve 21, heated liquid 1*a* is introduced into the upper part of the pair of membranes 3.

The lower opening 32 of the pair of membranes 3 is provided with a deflector 22 so that condensate and released coatings of ice will not be mixed with the liquid which, in the above-mentioned case of operation, is an aqueous solution with, for example, calcium chloride or monopropylene glycol.

Figure 5:
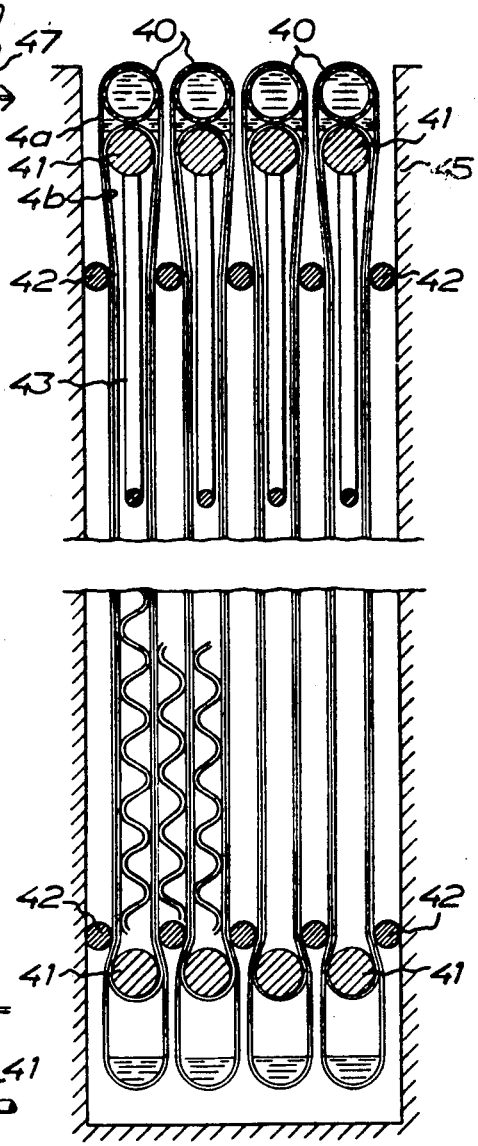

A practical embodiment of a heat exchanger for air/-liquid will now be described with reference to FIGS. 4 and 5.

The heat exchanger comprises a number of identical band-shaped membranes 4*a*, 4*b* of, for example, polyester film which has a width of 1.0 m and a thickness of 50 μm and which is chemically matted on one side. The membranes 4*a* are in the form of endless loops which are hung each over one liquid-distributing apertured pipe 40, while the membranes 4*b* which also are in the form of endless loops, are strung between supporting rods 41 within the loops of the membranes 4*a*, whereby the two loops will form two pairs of membranes. The cross-sectional dimensions of the pipes 40 and the supporting rods are approximately the same so that the membranes will contact one another with their matted surfaces. The supporting rods are carried by a structure 43 which is fixedly secured, and the loops are slightly compressed at a distance from their ends by means of rods 42 extending in parallel with the pipes 40 and the supporting rods 44. The ends of the outer loops with the membranes 4*a* are obliquely cut off and welded together so that, when the loops are hung from the pipes 40, the free lower end will incline in one direction, as shown at 44 in FIG. 4. In the embodiment according to FIG. 5, four outer loops with membranes 4*a* are hung adjacent one another each from one tube 40 and each contain one inner loop with a membrane 4*b*, and the entire arrangement is accommodated by a casing 45 carrying the pipes 40, the structure 43 with the supporting rods 41, and the rods 42. The casing 45 has a bottom 49 which is inclined in the same manner as the inclined lower ends of the outer loops, as shown in FIG. 4, and an outlet pipe 50 in its lowermost portion. Lower pipe sockets 46 for the supply of air are also secured to the casing, and upper apertures are provided for the discharge of air.

If liquid is supplied to the pipes 40 from a distributing pipe 48, it will be uniformly distributed over all of the pairs of membranes 4*a*, 4*b* and, furthermore, will be uniformly supplied over the entire width of each pair of membranes. As has previously been mentioned, the liquid flows downwards through the pairs of membranes 4*a*, 4*b* in the form of a film 5 spreading under capiliary action, while heat exchange is effected with an air flow 2 supplied via the pipe sockets 46 and moving upwardly in the gaps between the pairs of membranes. The liquid is deflected along the oblique lower edge of the outer loop with the membrane 4*b* and the outlet pipe 50, while the upwardly moving air is discharged via the apertures 47.

The heat exchange described above can be adapted to many different types of operation by variation of such parameters as width and height, the number of pairs of membranes, the width of the air gap, and the flow rates of air and liquid. The heat exchanger can be provided at low cost with very large heat-exchanging surfaces since the membrane material included therein is very inexpensive.

I claim:

1. A method for the exchange of heat between a liquid and air, said method comprising:

(a) providing at least two independent, band-shaped thin membranes suspended vertically and independently of each other, (b) positioning opposite surfaces of said membranes in closely spaced relationship, (c) uniformly supplying a liquid between the upper portions of the membranes and along the width thereof to flow between the membranes by gravity and form a liquid film that spreads under capillary action to hold the membranes by the adhesive forces in the liquid film, (d) conducting air into contact with the surfaces of said membranes that face away from each other, and (e) collecting the liquid from the lower part of the space between said membranes.

2. A method as claimed in claim 1, wherein the air is conducted in a direction opposite to the direction of flow of the liquid.

3. A method as claimed in claim 1, including the step of periodically supplying heated liquid between the membranes for removing any coatings of frost on the outer surfaces of the membranes.

4. An apparatus for effecting heat exchange between liquid and air, said apparatus comprising:

at least two independent, band-shaped thin membranes suspended vertically and independently of one another, the opposite surfaces of which membranes are disposed in spaced relationship at a slight distance away from one another to receive therebetween a liquid film that spreads under capillary action, means for supplying and uniformly distributing a liquid in the upper part of the space between said membranes, means for collecting the liquid from the lower part of said space between said membranes, and means for conducting the air into contact with the surfaces of said membranes that face away from one another.

5. An apparatus as claimed in claim 4, wherein the upper part of the space between the membranes is connected to an open supply vessel and a flow-controlling throttle is provided for uniformly supplying liquid between the membranes along the entire width thereof.

6. An apparatus as claimed in claim 4 or 5, wherein the liquid contacting surfaces of the membranes that face one another have a low surface tension relative to the liquid.

7. An apparatus as claimed in claims 4 or 5, wherein said membranes comprise a plastic film whose surface intended to contact the liquid has been chemically or mechanically processed to provide a low surface tension.

8. An apparatus as claimed in claims 4 or 5, wherein the membranes are formed of an outer endless film loop which is hung from a pipe forming the supply vessel, and an inner endless film loop which is supported within the outer film loop, such that the outwardly facing surfaces of the parts of the inner loop and the inwardly facing surfaces of the parts of the outer loop form pair of spaced membranes.

9. An apparatus as claimed in claim 8, wherein the lower end of said outer loop is oblique, such that the lowermost edge of the loop, after suspension thereof, is inclined towards one or the other long side of the loop in order to conduct liquid to said collecting means.

10. An apparatus as claimed in claims 4 or 5, including means for stopping the liquid flow periodically and means for supplying heated liquid for removing any coatings of frost on the outer surfaces of the membranes.

* * * * *